US011639719B2

(12) United States Patent
Hu et al.

(10) Patent No.: US 11,639,719 B2
(45) Date of Patent: May 2, 2023

(54) PUMP BODY ASSEMBLY WITH A PISTON SLEEVE HAVING PROTRUSIONS FOR LIMITING RADIAL MOVEMENT BETWEEN THE PISTON SLEEVE AND THE STRUCTURAL MEMBERS

(71) Applicant: GREE ELECTRIC APPLIANCES, INC. OF ZHUHAI, Zhuhai (CN)

(72) Inventors: Yusheng Hu, Zhuhai (CN); Huijun Wei, Zhuhai (CN); Jia Xu, Zhuhai (CN); Zhongcheng Du, Zhuhai (CN); Sen Yang, Zhuhai (CN); Zhi Li, Zhuhai (CN); Liping Ren, Zhuhai (CN); Shebing Liang, Zhuhai (CN); Rongting Zhang, Zhuhai (CN); Zhengliang Shi, Zhuhai (CN); Xixing Liu, Zhuhai (CN); Pengkai Wan, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 123 days.

(21) Appl. No.: 17/056,752

(22) PCT Filed: Dec. 13, 2018

(86) PCT No.: PCT/CN2018/120955
§ 371 (c)(1),
(2) Date: Nov. 18, 2020

(87) PCT Pub. No.: WO2020/015291
PCT Pub. Date: Jan. 23, 2020

(65) Prior Publication Data

US 2021/0156379 A1 May 27, 2021

(30) Foreign Application Priority Data

Jul. 18, 2018 (CN) ..... 201810791303.8

(51) Int. Cl.
*F04C 2/22* (2006.01)
*F04C 29/00* (2006.01)
*F04C 2/344* (2006.01)

(52) U.S. Cl.
CPC ..... *F04C 2/22* (2013.01); *F04C 29/00* (2013.01); *F04C 2/344* (2013.01); *F04C 2240/10* (2013.01); *F04C 2240/80* (2013.01)

(58) Field of Classification Search
CPC ..... F04C 2/22; F04C 29/00; F04C 2240/10; F04C 2240/80; F04C 18/344; F04C 2/344; F04C 18/22
See application file for complete search history.

(56) References Cited

U.S. PATENT DOCUMENTS 11,208,990 B2 * 12/2021 Wei ..... F04C 18/344

FOREIGN PATENT DOCUMENTS

CN 204877939 U 12/2015
CN 206206177 U 5/2017
(Continued)

OTHER PUBLICATIONS

Foreign Patent and Machine Translation of CN-105604937-A, Inventors: Zhang et al, Title: Fluid Machine and Heat Exchange Device, published May 25, 2016. (Year: 2016).*
(Continued)

*Primary Examiner* — Mary Davis
(74) *Attorney, Agent, or Firm* — Kilpatrick Townsend & Stockton, LLP

(57) ABSTRACT

A pump body assembly, fluid machinery, and a heat exchange device. The pump body assembly includes: at least two structure members; a cylinder disposed between the two structure members; and a piston assembly disposed in the cylinder. The piston assembly includes a piston sleeve and a piston slidably disposed in the piston sleeve; an upper end
(Continued)

surface of the piston sleeve fits and is limited by a lower end surface of one structure member disposed above the piston sleeve, to prevent the piston sleeve from displacing along a radial direction relative to the one structure member, and effectively solving a problem in prior art that working efficiency of the pump body assembly is affected because the piston sleeve of the pump body assembly is prone to eccentrically rotate.

7 Claims, 14 Drawing Sheets

(56) References Cited

FOREIGN PATENT DOCUMENTS

| | | | | |
|---|---|---|---|---|
| CN | 107035693 | A | 8/2017 | |
| CN | 108799104 | A | 11/2018 | |
| CN | 108799105 | A | 11/2018 | |
| CN | 108869278 | A | 11/2018 | |
| CN | 108869279 | A | 11/2018 | |
| JP | S59155580 | A | 9/1984 | |
| WO | 2017125048 | A1 | 7/2017 | |
| WO | 2018018880 | A1 | 2/2018 | |
| WO | WO-2018018880 | A1 * | 2/2018 | ..... F04C 15/0057 |

OTHER PUBLICATIONS

Machine Translation of JP 59-155580 A, Inventors: Hayase, Title: Capacity Control Type Compressor. Published Sep. 4, 1984 (Year: 1984).*

* cited by examiner

PUMP BODY ASSEMBLY WITH A PISTON SLEEVE HAVING PROTRUSIONS FOR LIMITING RADIAL MOVEMENT BETWEEN THE PISTON SLEEVE AND THE STRUCTURAL MEMBERS

CROSS REFERENCE TO RELATED APPLICATIONS

This application claims all benefits accruing under 35 U.S.C. § 119 from China Patent Application No. 201810791303.8, filed on Jul. 18, 2018 in the China National Intellectual Property Administration, the entire content of which is hereby incorporated by reference. This application is a national phase under 35 U.S.C. § 120 of international patent application PCT/CN2018/120955, entitled "PUMP BODY ASSEMBLY, FLUID MACHINERY, AND HEAT EXCHANGE DEVICE" filed on Dec. 13, 2018, the content of which is also hereby incorporated by reference.

FIELD

The present disclosure relates to a field of pump body assembly, and more particularly, to a pump body assembly, fluid machinery, and a heat exchange device.

BACKGROUND

At present, during the operation of the pump body assembly, the piston sleeve is prone to rotate eccentrically and aslant, which causes friction between the piston sleeve, the cylinder, and the piston, thus seriously affecting working efficiency and performance of the pump body assembly.

SUMMARY

The present disclosure provides a pump body assembly, fluid machinery, and a heat exchange device, to solve the problem known to the inventors that the working efficiency of the pump body assembly is affected because the piston sleeve of the pump body assembly is prone to rotate eccentrically.

According to one aspect of the present disclosure, a pump body assembly is provided and includes: at least two structure members, a cylinder arranged between the two structure members, and a piston assembly arranged in the cylinder; the piston assembly includes a piston sleeve and a piston slidably arranged in the piston sleeve; an upper end surface of the piston sleeve fits and is limited by a lower end surface of one structure member disposed above the piston sleeve to prevent the piston sleeve from moving in a radial direction relative to the one structure member.

In some embodiments, the one structure member disposed above the piston sleeve is an upper flange (11).

In some embodiments, the upper end surface of the piston sleeve has a first extended part; the lower end surface of the upper flange has a concave part; and the first extended part extends into the concave part, and is limited and stopped by the concave part in a radial direction of the piston sleeve.

In some embodiments, the lower end surface of the upper flange has a position-limiting part extending toward the piston sleeve, and the piston sleeve is limited and stopped by the position-limiting part to prevent the piston sleeve from moving in a radial direction relative to the upper flange.

In some embodiments, the position-limiting part extends into the piston sleeve, limits and stops an inner surface of the piston sleeve.

In some embodiments, the upper end surface of the piston sleeve has a first position-limiting groove, and the position-limiting part extends into the first position-limiting groove to limit and stop the first position-limiting groove.

In some embodiments, the at least two structure members comprise a lower flange located below the piston assembly; a position-limiting protrusion is provided on a surface of the piston sleeve, and the surface of the piston sleeve faces the lower flange; the pump body assembly In some embodiments includes a lower friction-reducing ring arranged inside the cylinder; the lower friction-reducing ring has a central hole; and the position-limiting protrusion extends into the central hole, and is limited and stopped by the lower flange to prevent the piston sleeve from moving in the radial direction relative to the lower flange.

In some embodiments, a second position-limiting groove is provided on a surface of the lower flange, and the surface of the lower flange faces the piston sleeve; the position-limiting protrusion extends into the second position-limiting groove to prevent the piston sleeve from moving in the radial direction relative to the lower flange.

In some embodiments, a second extended part is provided on the surface of the lower flange, and the surface of the lower flange faces the piston sleeve; the second extended part limits and stops the position-limiting protrusion to prevent the piston sleeve from moving in the radial direction relative to the lower flange.

In some embodiments, the second extended part is located outside the position-limiting protrusion.

In some embodiments, the second extended part is located inside the position-limiting protrusion.

In some embodiments, the position-limiting protrusion is a protruding ring extending toward the lower flange, and the protruding ring and the piston sleeve are coaxially arranged.

In some embodiments, the position-limiting protrusion includes a plurality of protruding platforms extending toward the lower flange, and the plurality of protruding platforms are arranged at intervals along a circumference of the piston sleeve.

In some embodiments, a position-limiting protrusion is provided on a lower end surface of the piston sleeve; the position-limiting protrusion fits another structure member located below the cylinder to prevent the piston sleeve from moving in the radial direction relative to the other structure member.

In some embodiments, the other structure member located below the cylinder is a lower flange.

In some embodiments, a second position-limiting groove is provided on a surface of the lower flange, and the surface of the lower flange faces the piston sleeve; the position-limiting protrusion extends into the second position-limiting groove to prevent the piston sleeve from moving in the radial direction relative to the lower flange.

In some embodiments, the at least two structure members includes a lower flange and a lower position-limiting plate; the lower position-limiting plate and the lower flange are both disposed below the cylinder; the lower position-limiting plate is disposed between the cylinder and the lower flange; the position-limiting protrusion is limited and stopped by the lower position-limiting plate to prevent the piston sleeve from moving in the radial direction relative to the lower position-limiting plate.

In some embodiments, the position-limiting protrusion extends into a central hole of the lower position-limiting plate, fits and is limited by an inner surface of the central hole of the lower position-limiting plate.

In some embodiments, a surface of the lower position-limiting plate, which faces a surface of the piston sleeve, has a third position-limiting groove, and the position-limiting protrusion extends into the third position-limiting groove, and is limited and stopped by the third position-limiting groove.

In some embodiments, the at least two of the structure members include a lower flange located below the piston assembly, and the pump body assembly further includes a rotation shaft; the rotation shaft (30) passes through the upper flange, the piston sleeve and the lower flange in sequence; and the rotation shaft, the upper flange, and the lower flange are arranged coaxially.

According to another aspect of the present disclosure, fluid machinery is provided and includes the pump body assembly above.

According to another aspect of the present disclosure, a heat exchange device is provided and includes the fluid machinery.

In the solution applying the present disclosure, the pump body assembly includes the at least two structure members, the cylinder and the piston assembly. Where the cylinder is arranged between the two structure members. The piston assembly is arranged in the cylinder. The piston assembly includes the piston sleeve and the piston slidably arranged in the piston sleeve. The upper end surface of the piston sleeve fits and is limited by the lower end surface of the structure member disposed above the piston sleeve, to prevent the piston sleeve from moving in the radial direction relative to the structure member. In this case, during the operation of the pump body assembly, the upper end of the piston sleeve is limited and supported by the structure member disposed above it, preventing the piston sleeve from moving in the radial direction during operation, ensuring the piston sleeve to rotate normally, solving the problem known to the inventors that the working efficiency of the pump body assembly is affected because the piston sleeve of the pump body assembly is prone to rotate eccentrically, and improving the operation reliability and the working performance of the pump body assembly.

BRIEF DESCRIPTION OF THE DRAWINGS

The accompanying drawings attached to the specification form a part of the present disclosure and are intended to provide a further understanding of the present disclosure. The illustrative embodiments of the present disclosure and the description thereof are used for explanations of the present disclosure, and do not constitute improper limitations of the present disclosure. In the accompanying drawings.

DETAILED DESCRIPTION OF THE EMBODIMENTS

Figure 1:
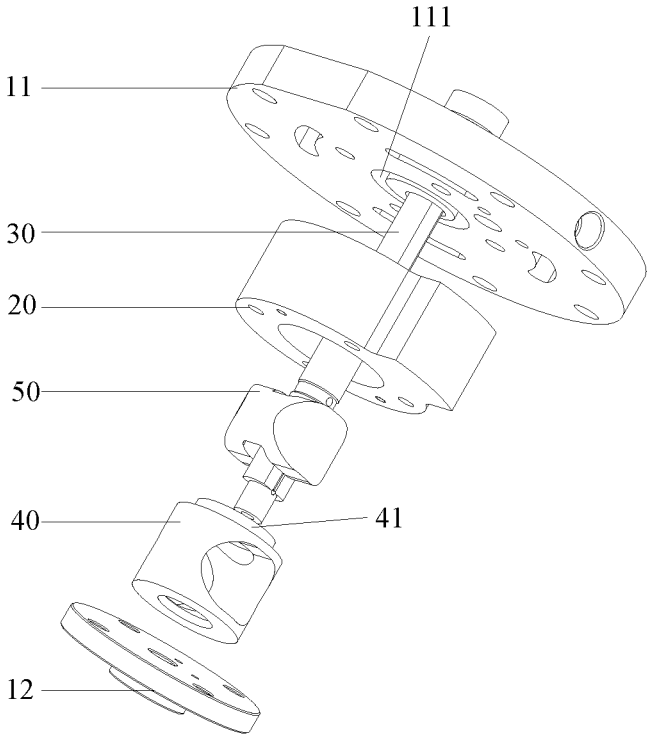
FIG. 1 shows a schematic exploded view of a pump body assembly according to a first embodiment of the present disclosure.

It should be noted that the embodiments in the present disclosure and the features in the embodiments can be combined with each other if no conflicts occur. The present disclosure will be described in detail below with reference to the accompanying drawings in combination with the embodiments.

It should be noted that, unless otherwise indicated, all technical and scientific terms used herein have the same meanings as commonly understood in the art of the present disclosure.

In the present disclosure, unless stated to the contrary, the orientation words such as "up, down" are usually used to refer to the orientations shown in the drawings, or to the component itself in the vertical, orthographic or gravity direction. Similarly, in order to facilitate the understanding and the description, "left, right" are usually used to refer to the left and right shown in the drawings, and "inner" and "outer" refer to "inner" and "outer" relative to the outline of each component itself. However, the orientation words are not given to limit the present disclosure.

In order to solve the problem known to the inventors that the working efficiency of the pump body assembly is affected because the piston sleeve of the pump body assembly is prone to rotate eccentrically, the present disclosure provides a pump body assembly, fluid machinery, and a heat exchange device.

First Embodiment

As shown in FIGS. 1 to 4, the pump body assembly includes two structure members, a cylinder 20 and a piston assembly. The cylinder 20 is arranged between the two structure members. The piston assembly is arranged in the cylinder 20. The piston assembly includes a piston sleeve 40 and a piston 50 slidably arranged in the piston sleeve 40. An upper end surface of the piston sleeve 40 fits and is limited by a lower end surface of the structure member disposed above the piston sleeve 40, to prevent the piston sleeve 40 from moving in a radial direction relative to the structure member.

In this embodiment of the disclosure, during the operation of the pump body assembly, the upper end of the piston sleeve 40 is limited and supported by the structure member disposed above it, preventing the piston sleeve 40 from moving in the radial direction during operation, ensuring the piston sleeve 40 to rotate normally, solving the problem known to the inventors that the working efficiency of the pump body assembly is affected because the piston sleeve of the pump body assembly is prone to rotate eccentrically, and improving the operation reliability and the working performance of the pump body assembly.

In this embodiment, the structure member disposed above the piston sleeve 40 is an upper flange 11.

Figure 2:
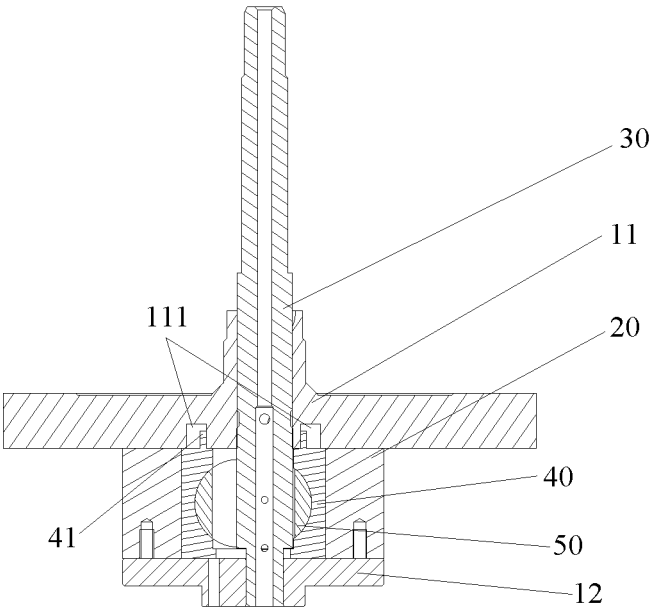
FIG. 2 shows a cross-sectional view of the pump body assembly in FIG. 1.
Figure 3:
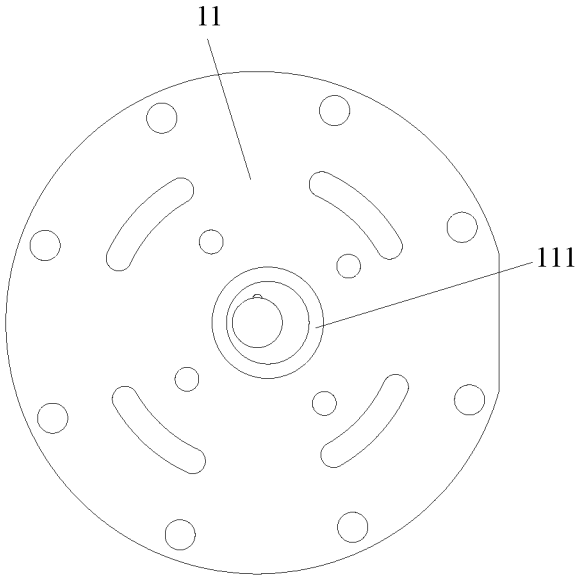
FIG. 3 shows a bottom view of an upper flange of the pump body assembly in FIG. 1.
Figure 4:
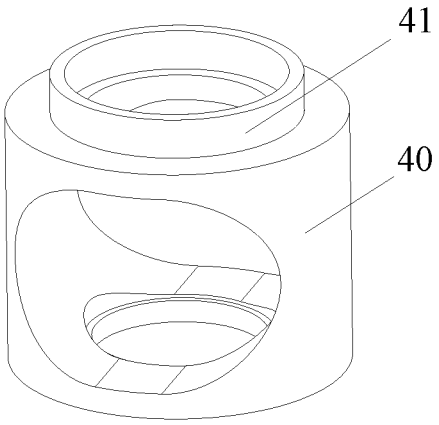
FIG. 4 shows a schematic perspective view of a piston sleeve of the pump body assembly in FIG. 1.
Figure 5:
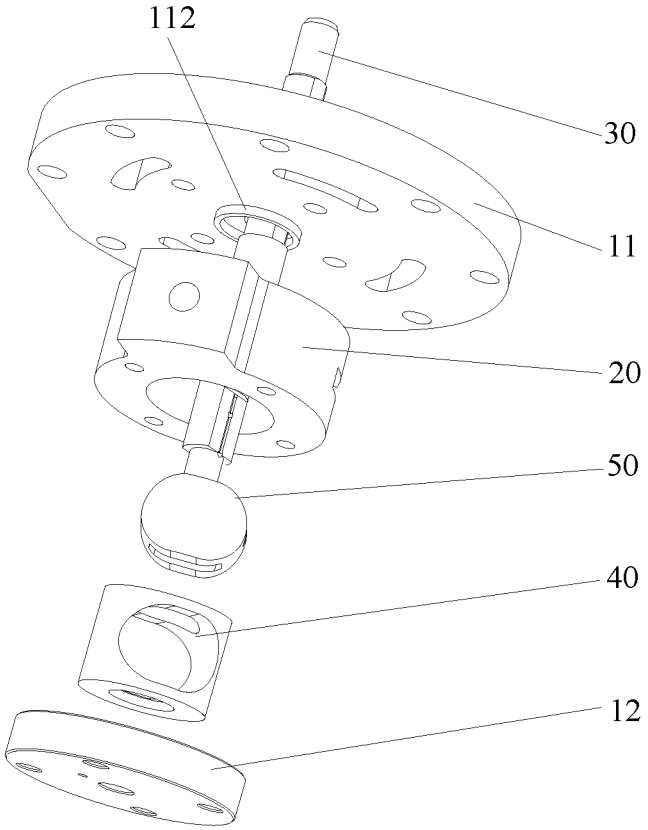
FIG. 5 shows a schematic exploded view of a pump body assembly according to a second embodiment of the present disclosure.

As shown in FIGS. 1 to 3, the upper end surface of the piston sleeve 40 has a first extended part 41; the lower end surface of the upper flange 11 has a concave part 111; and the first extended part 41 extends into the concave part 111, and is limited and stopped by the concave part 111 in a radial direction of the piston sleeve 40. In this case, the first extended part 41 of the piston sleeve 40 extends into the concave part 111 of the upper flange 11, realizing, by the upper flange 11, a position limitation to the piston sleeve 40 in the radial direction. During the operation of the pump body assembly, the convex part 111 limits and stops the first extended part 41, which ensures that the first extended part 41 rotates in the convex part 111, preventing the first extended part 41 from moving in the radial direction, realizing, by the upper flange 11, the position limitation and a support for the upper end of the piston sleeve 40, preventing the piston sleeve 40 from rotating eccentrically and aslant, ensuring the pump body assembly to operate normally, and improving the working reliability of the pump body assembly.

In this embodiment, the first extended part 41 and the concave part 111 are ring-shaped, and the first extended part 41, the concave part 111, and the piston sleeve 40 are coaxially arranged. In this case, the above arrangement enables the piston sleeve 40 to rotate relative to the upper flange 11, ensuring the operation reliability of the pump body assembly. The piston sleeve 40 and the upper flange 11 are eccentrically arranged, and an eccentricity thereof is an eccentricity e of the pump body assembly. In this case, the above arrangement enables the first extended part 41 of the piston sleeve 40 to rotate in the concave part 111 of the upper flange 11 and rotate around a central axis of the piston sleeve 40 (or around a central axis of the concave part 111), thus ensuring reliability of the position limitation and the support provided by the upper flange for the piston sleeve 40.

It should be noted that the first extended part 41 is not limited to such a structure. In one embodiment, the first extended part 41 is a double-layered ring-shaped structure, and at least one layer of the ring-shaped structure is limited and stopped by an inner groove wall or an outer groove wall of the concave part 111. In this case, the above arrangement makes the structure of the first extended part 41 more diversified, making the processing and manufacturing of the piston sleeve 40 easier and simpler, and reducing labor intensity of staff.

In this embodiment, the concave part 111 is a groove. The above-mentioned structure is simple, and easy to process and implement.

In this embodiment, a width of the groove is greater than a thickness of the first extended part 41. In this case, the above arrangement ensures that the first extended part 41 is located in the groove, ensuring that the groove can limit and stop the first extended part 41, improving the reliability of the position limitation provided by the upper flange 11 for the piston sleeve 40, and improving the operation reliability of the pump body assembly.

In this embodiment, there is a first predetermined distance between an inner groove wall of the groove and a side surface of the first extended part 41 proximate to the center of the piston sleeve 40, and the first predetermined distance is greater than or equal to 5 um, and less than or equal to 40 um. Specifically, the inner groove wall of the groove limits and stops the side surface of the first extended part 41 proximate to the center of the piston sleeve 40, preventing a radial displacement there between. Moreover, in order to ensure that the piston sleeve 40 can rotate normally, the first predetermined distance, between the inner groove wall of the groove and the side surface of the first extended part 41 proximate to the center of the piston sleeve 40, is set, which not only ensures the groove to radially limit the position of the first extended part 41, but also enables the first extended part 41 to rotate relative to the groove, improving the operation reliability of the pump body assembly.

In this embodiment, the convex part 111 and the upper flange 11 are eccentrically arranged, and the eccentricity is e. In this case, the eccentricity of the pump body assembly is determined in the above manner, making it easier to guarantee the eccentricity of the pump body assembly, and the determination of the eccentricity e is more reliable and simple.

As shown in FIGS. 1 and 2, the pump body assembly further includes a lower flange 12 and a rotation shaft 30. The lower flange 12 is disposed below the piston assembly. The rotation shaft 30 passes through the upper flange 11, the piston sleeve 40, and the lower flange 12 in sequence; and the rotation shaft 30, the upper flange 11, and the lower flange 12 are arranged coaxially. During the operation of the pump body assembly, the rotation shaft 30 rotates around the central axis of the upper flange 11; the piston sleeve 40 rotates around the central axis of the concave part 111; the piston 50 only reciprocates relative to the piston sleeve 40; and the piston 50 reciprocates relative to the rotation shaft 30. The two reciprocating motions are perpendicular to each other, that is, the operation of the pump body assembly follows the principle of the cross slide block type mechanism. With the reciprocating motion between the piston 50 and the piston sleeve 40, the volumes of two cavities formed between a curved surface of the head of the piston 50, the inner surface of the cylinder 20, and the guiding hole of the piston sleeve 40 gradually change, completing a process of intake, compression and exhausting.

The present disclosure further provides fluid machinery (not shown), including the above-mentioned pump body assembly. In one embodiment, the fluid machinery is a compressor.

The present disclosure further provides a heat exchange device (not shown), including the above-mentioned fluid machinery. In one embodiment, the heat exchange device is an air conditioner.

Second Embodiment

The pump body assembly of the second embodiment differs from that of the first embodiment in that structures of the upper flange 11, the piston sleeve 40, and the lower flange 12 are different respectively.

As shown in FIGS. 5-9, the lower end surface of the upper flange 11 has a position-limiting part 112 extending toward the piston sleeve 40, and the piston sleeve 40 is limited and stopped by the position-limiting part 112, to prevent the piston sleeve 40 from moving in a radial direction relative to the upper flange 11. Where, the position-limiting part 112 extends into the piston sleeve 40, limits and stops an inner surface of the piston sleeve 40. In this case, the position-limiting part 112 of the upper flange 11 extends into the piston sleeve 40, limits and stops the inner surface of the piston sleeve 40, realizing, by the upper flange 11, a position limitation to the piston sleeve 40 in the radial direction. During the operation of the pump body assembly, the inner surface of the piston sleeve 40 is limited and stopped by the position-limiting part 112 to prevent the piston sleeve 40 from moving in the radial direction, realizing, by the upper flange 11, the position limitation to and the support for an upper end of the piston sleeve 40, preventing the piston sleeve 40 from rotating eccentrically and aslant, ensuring the pump body assembly to operate normally, and improving the working reliability of the pump body assembly.

Figure 9:
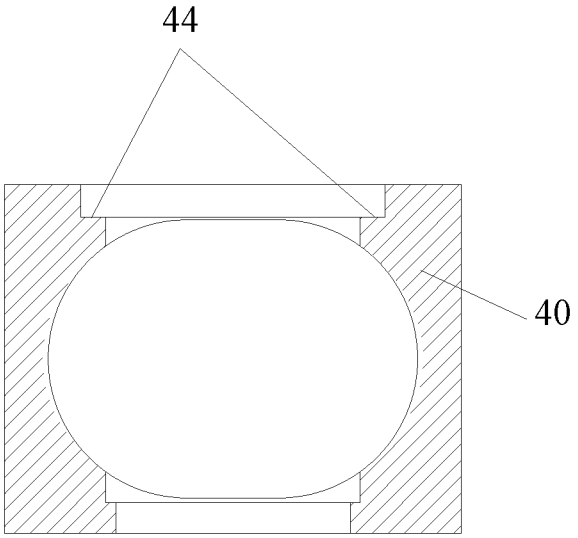
FIG. 9 shows a cross-sectional view of a piston sleeve of the pump body assembly in FIG. 5.

As shown in FIG. 9, a step surface 44 is disposed on the inner surface of the piston sleeve 40, and the step surface 44 is disposed at one end of the piston sleeve 40, and the one end of the piston sleeve 40 faces the upper flange 11. The position-limiting part 112 extends to the step surface 44 to limit and stop the step surface 44, achieving, by the upper flange 11, the position limitation to the piston sleeve 40 in the radial direction.

In this embodiment, the position-limiting part 112 and the piston sleeve 40 are coaxially arranged. Where, the position-limiting part 112 and the upper flange 11 are eccentrically arranged, and the eccentricity is e. In this case, the eccentricity of the pump body assembly is determined in the above manner, which makes it easier to guarantee the eccentricity of the pump body assembly, and the determination of the eccentricity e is more reliable and simple.

Figure 6:
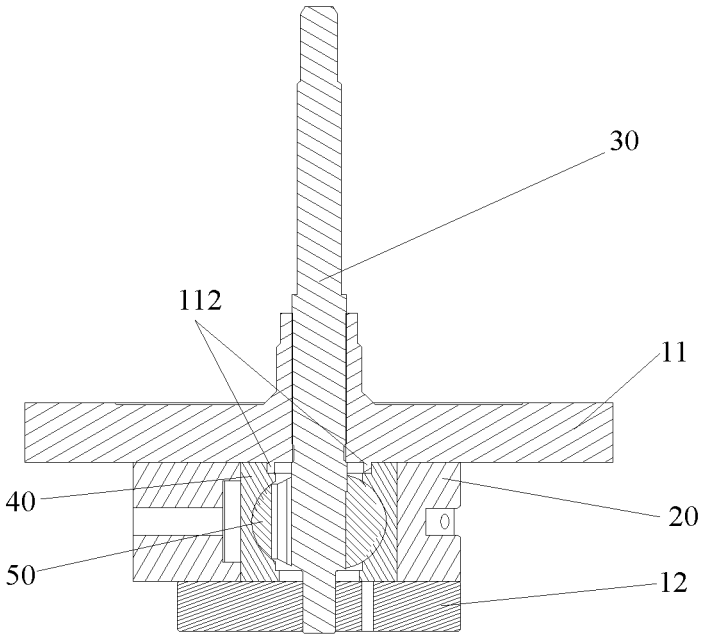
FIG. 6 shows a cross-sectional view of the pump body assembly in FIG. 5.
Figure 7:
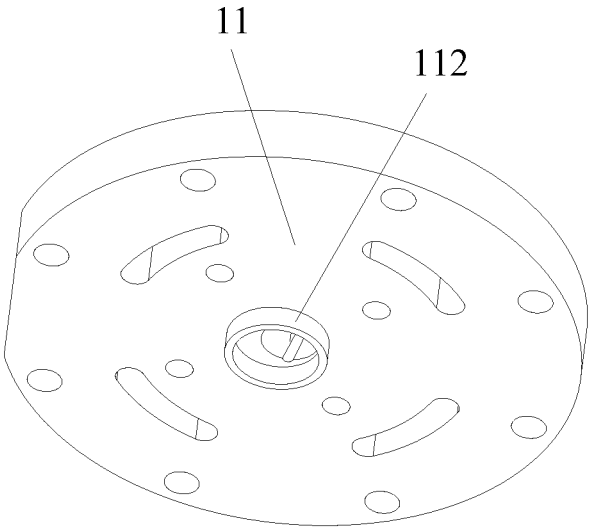
FIG. 7 shows a schematic perspective view of an upper flange of the pump body assembly in FIG. 5.
Figure 8:
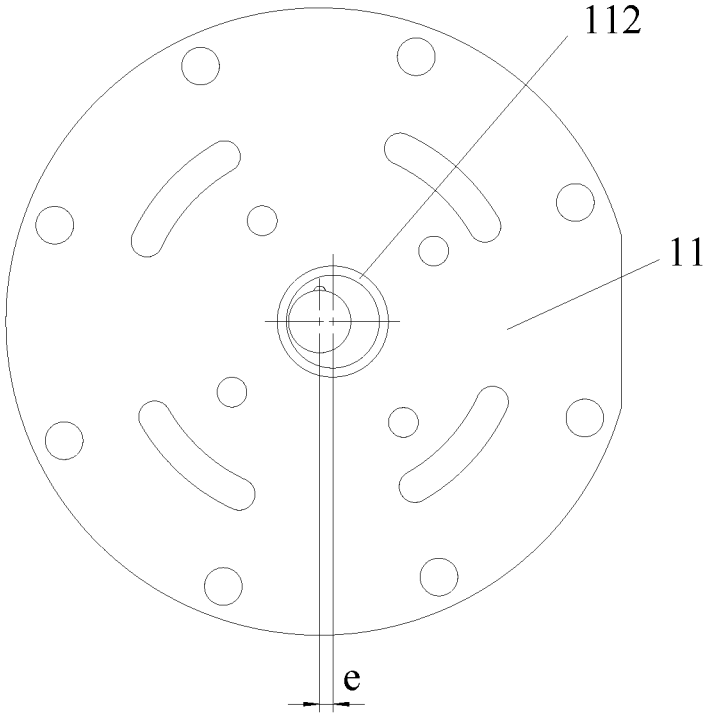
FIG. 8 shows a bottom view of the upper flange of the pump body assembly in FIG. 5.

As shown in FIG. 6, an eccentric protruding platform is provided on a surface of the lower flange 12, and the surface of the lower flange 12 faces the piston sleeve 40. The eccentric protruding platform can limit and stop the lower end of the piston sleeve 40 to prevent the lower end of the piston sleeve 40 from moving in the radial direction relative to the lower flange 12.

Third Embodiment

The pump body assembly of the third embodiment differs from that of the second embodiment in that structure of the piston sleeve 40 is different.

As shown in FIGS. 10-15, a position-limiting part 112 is provided on the lower end surface of the upper flange 11, and extends towards the piston sleeve 40. The piston sleeve 40 is limited and stopped by the position-limiting part 112, to prevent the piston sleeve 40 from moving in the radial direction relative to the upper flange 11. Where, the upper end surface of the piston sleeve 40 has a first position-limiting groove 42, and the position-limiting part 112 extends into the first position-limiting groove 42, to limit and stop the first position-limiting groove 42. In this case, the position-limiting part 112 of the upper flange 11 extends into the first position-limiting groove 42 of the piston sleeve 40, and the position-limiting part 112 limits and stops the first position-limiting groove 42, achieving, by the upper flange 11, the position limitation to the piston sleeve 40 in the radial direction, preventing the piston sleeve 40 from moving in the radial direction, realizing, by the upper flange 11, the position limitation to and the support for the upper end of the piston sleeve 40, preventing the piston sleeve 40 from rotating eccentrically and aslant, ensuring the pump body assembly to operate normally, and improving the working reliability of the pump body assembly.

Figure 10:
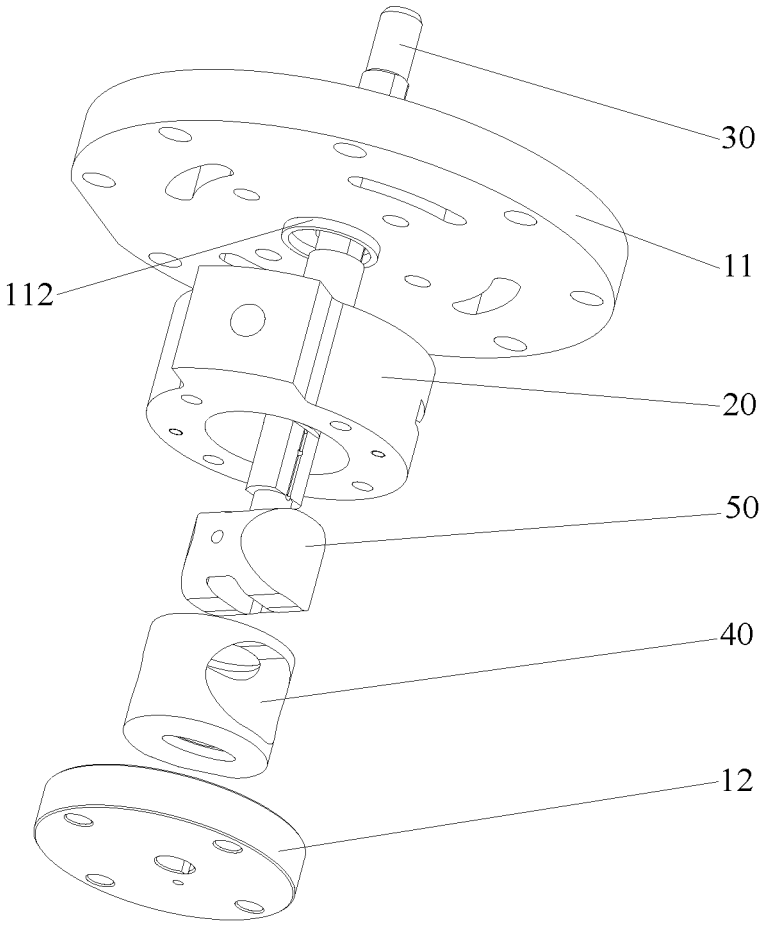
FIG. 10 shows a schematic exploded view of a pump body assembly according to a third embodiment of the present disclosure.
Figure 11:
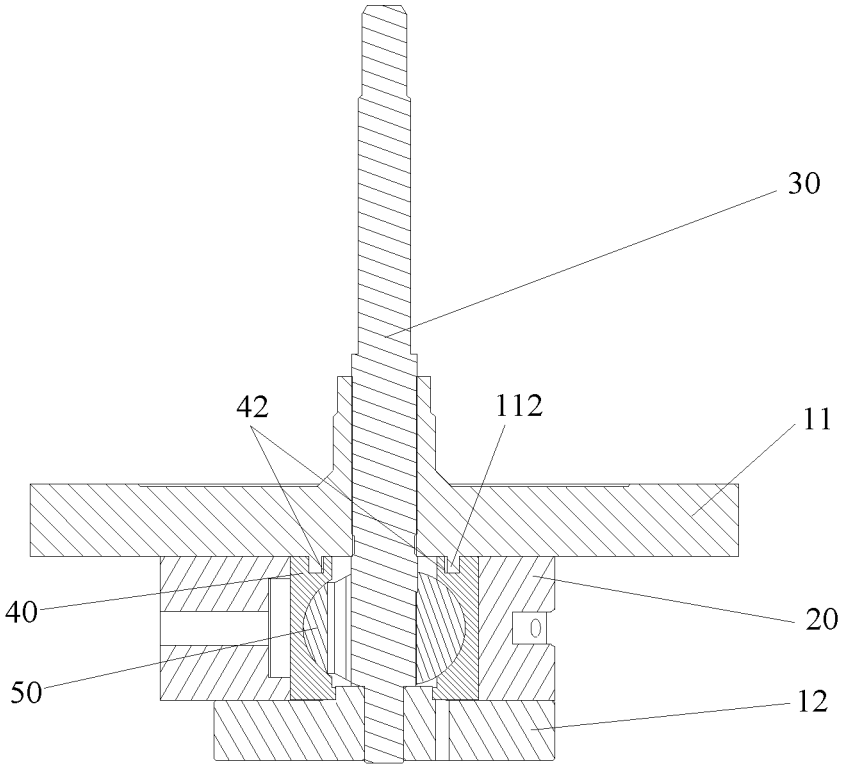
FIG. 11 shows a cross-sectional view of the pump body assembly in FIG. 10.
Figure 12:
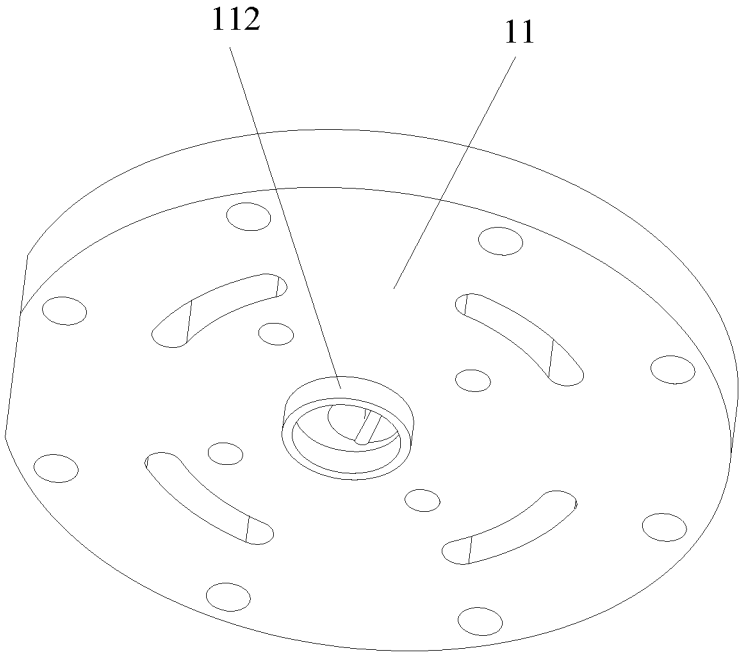
FIG. 12 shows a bottom view of an upper flange of the pump body assembly in FIG. 10.
Figure 13:
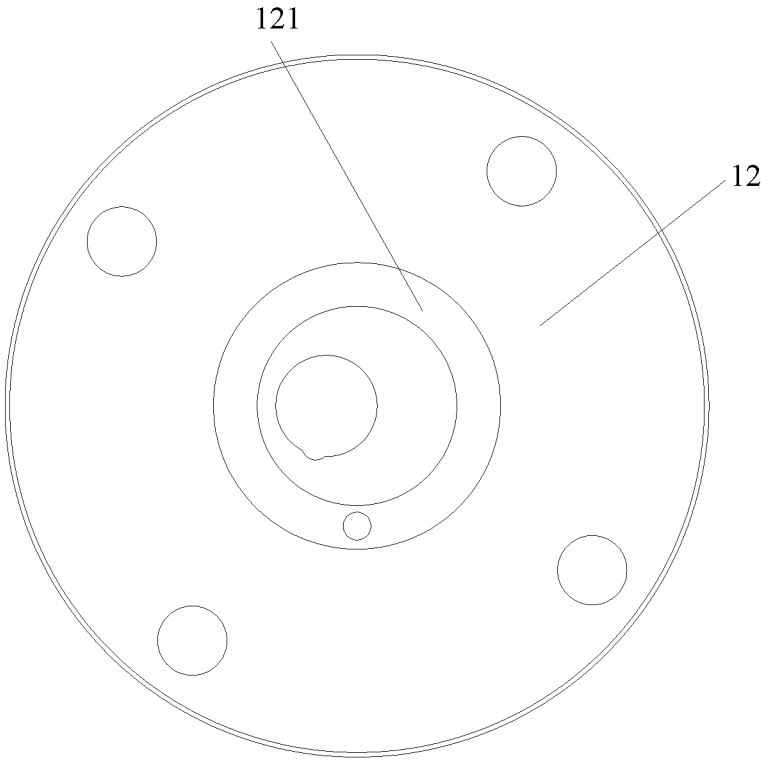
FIG. 13 shows a top view of a lower flange of the pump body assembly in FIG. 10.
Figure 14:
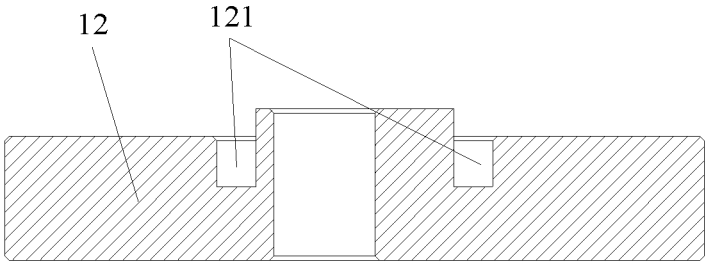
FIG. 14 shows a cross-sectional view of the lower flange in FIG. 13.
Figure 15:
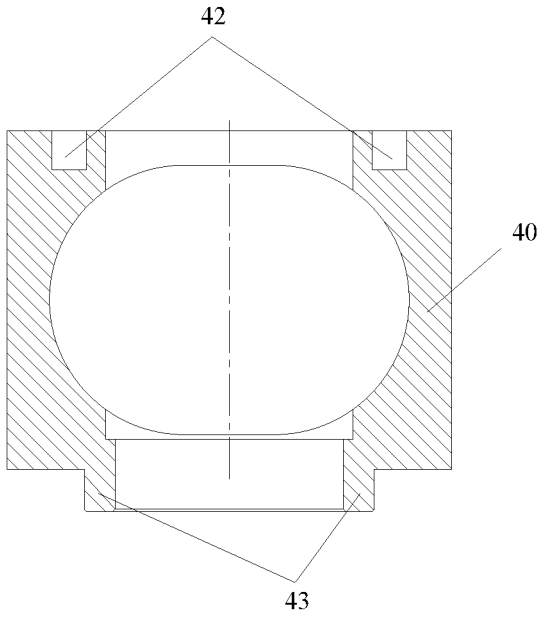
FIG. 15 shows a cross-sectional view of a piston sleeve of the pump body assembly in FIG. 10.
Figure 16:
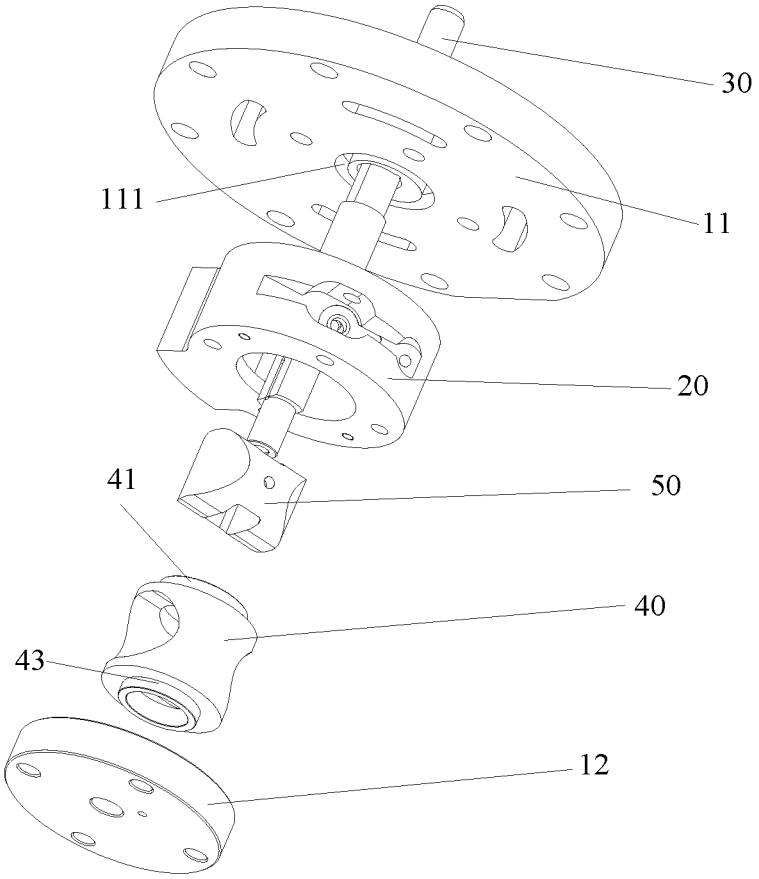
FIG. 16 shows a schematic exploded view of a pump body assembly according to a fourth embodiment of the present disclosure.
Figure 17:
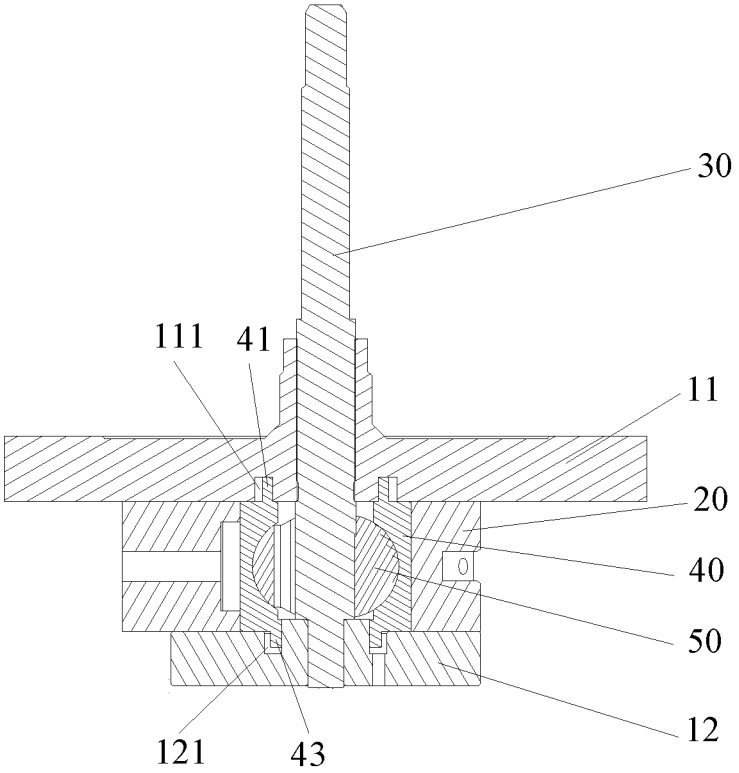
FIG. 17 shows a cross-sectional view of the pump body assembly in FIG. 16.
Figure 18:
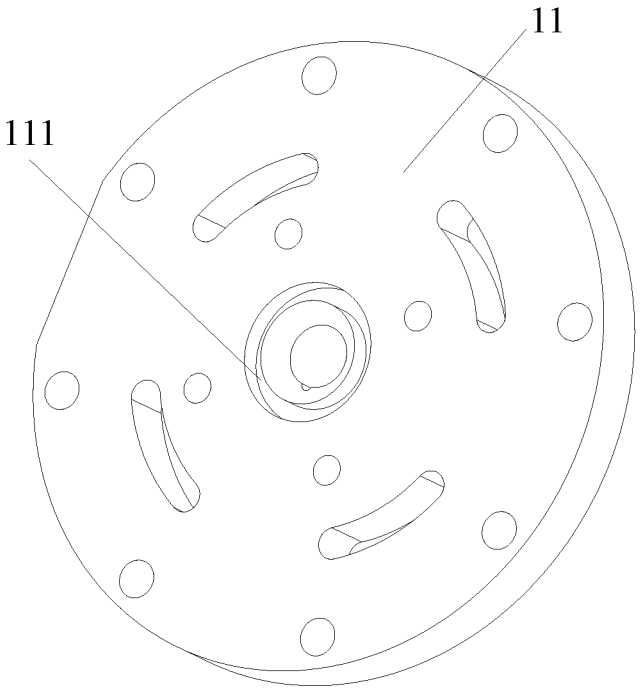
FIG. 18 shows a perspective view of an upper flange of the pump body assembly in FIG. 16.

As shown in FIG. 10, the position-limiting part 112, the first position-limiting groove 42, and the piston sleeve 40 are coaxially arranged. Where, the position-limiting part 112 and the upper flange 11 are eccentrically arranged, and the eccentricity is e. In this case, the eccentricity of the pump body assembly is determined in the above manner, making it easier to guarantee the eccentricity of the pump body assembly, and the determination of the eccentricity e is more reliable and simpler.

Fourth Embodiment

The pump body assembly of the fourth embodiment differs from that of the first embodiment in that the structure of the lower flange 12 is different.

As shown in FIG. 16 to FIG. 21, a position-limiting protrusion 43 is provided on a lower end surface of the piston sleeve 40, and the position-limiting protrusion 43 fits and limits another structure member located below the cylinder 20 thus preventing the piston sleeve 40 from moving in the radial direction relative to the other structure member. Where the other structure member located below the cylinder 20 is a lower flange 12. In this case, the position-limiting protrusion 43 of the piston sleeve 40 fits the lower flange 12, to limit the position of the piston sleeve 40 in the radial direction. At the same time, the upper end of the piston sleeve 40 is limited and supported by the upper flange 11, so that both the upper end and the lower end of the piston sleeve 40 are limited and supported, thus avoiding structural interference between the piston sleeve 40 and the piston 50 or cylinder 20, which will affect the normal operation of the pump body assembly, and improving the operation reliability and the working performance of the pump body assembly.

Figure 19:
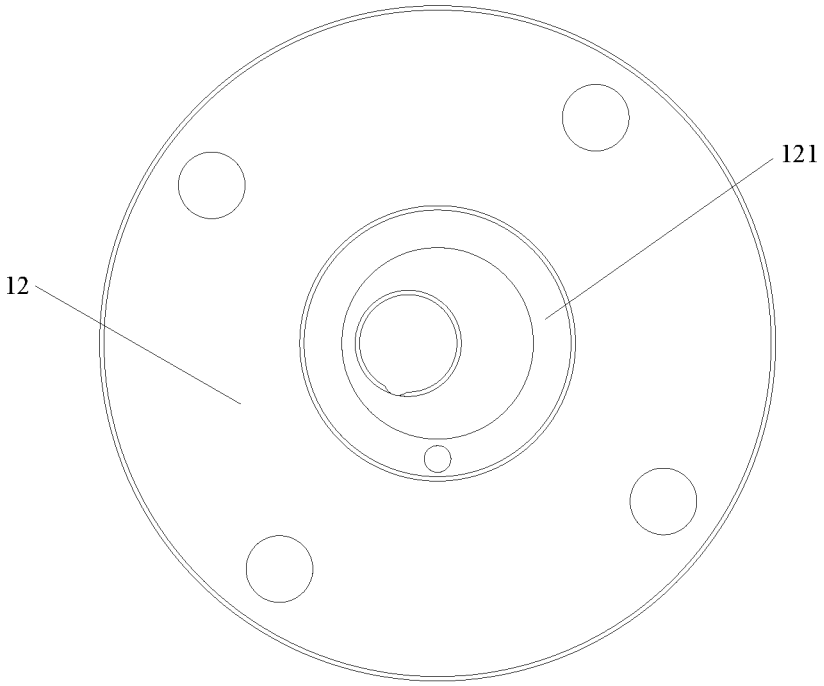
FIG. 19 shows a top view of a lower flange of the pump body assembly in FIG. 16.
Figure 20:
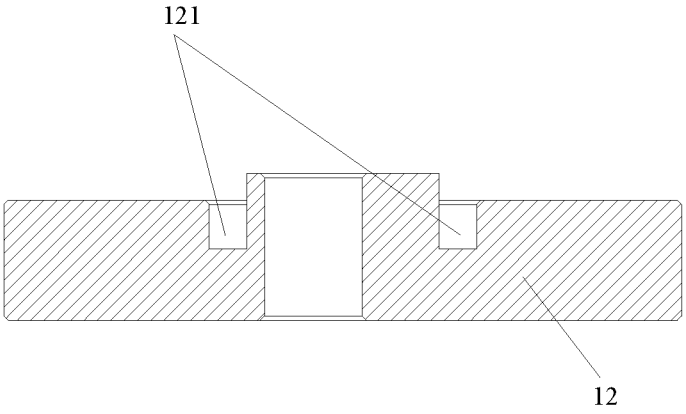
FIG. 20 shows a cross-sectional view of the lower flange in FIG. 19.
Figure 21:
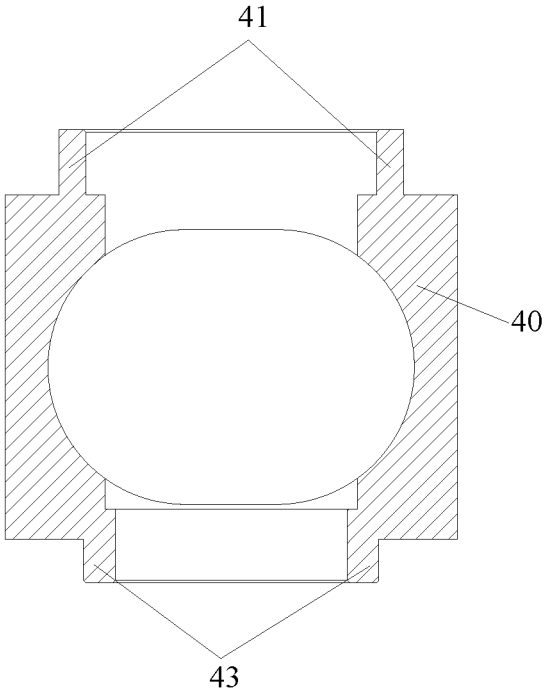
FIG. 21 shows a cross-sectional view of a piston sleeve of the pump body assembly in FIG. 16.

As shown in FIGS. 19 and 20, a second position-limiting groove 121 is provided on the surface of the lower flange 12, and the surface of the lower flange 12 faces the piston sleeve 40. The position-limiting protrusion 43 extends into the second position-limiting groove 121 to prevent the piston sleeve 40 from moving in the radial direction relative to the lower flange 12. Specifically, the second position-limiting groove 121 is eccentrically arranged on the lower flange 12, and the position-limiting protrusion 43 extends into the second position-limiting groove 121, realizing, by the lower flange 12, the position limitation and a stop to the piston sleeve 40.

Fifth Embodiment

The pump body assembly of the fifth embodiment differs from that of the fourth embodiment in that the structure of the pump body assembly is different.

As shown in FIGS. 22 to 25, the two structure members include the lower flange 12 located below the piston assembly; the position-limiting protrusion 43 is provided on the surface of the piston sleeve 40, and the surface of the piston sleeve faces the lower flange 12. The pump body assembly further includes a lower friction-reducing ring 60 arranged inside the cylinder 20. The lower friction-reducing ring 60 has a central hole, and the position-limiting protrusion 43 extends into the central hole, and is limited and stopped by the lower flange 12, to prevent the piston sleeve 40 from moving in the radial direction relative to the lower flange 12. In this case, the central hole of the lower friction-reducing ring 60 fits and limits the position-limiting protrusion 43 of the piston sleeve 40, and accordingly, the lower friction-reducing ring 60 realizes the position limitation to the piston sleeve 40 in the radial direction, limiting and stopping the lower end of the piston sleeve 40. At the same time, the upper end of the piston sleeve 40 is supported by the upper flange 11, so that both the upper end and the lower end of the piston sleeve 40 are limited and supported, avoiding structural interference between the piston sleeve 40 and the piston 50 or cylinder 20, which will affect the normal operation of the pump body assembly, and improving the working reliability of the pump body assembly.

Specifically, an outer surface of the lower friction-reducing ring 60 fits the inner circular surface of the cylinder 20, and an inner surface of the lower friction-reducing ring 60 fits the position-limiting protrusion 43 of the piston sleeve 40. The lower friction-reducing ring 60 rotates relative to the cylinder 20 and the position-limiting protrusion 43, and a rotation speed of the lower friction-reducing ring 60 relative to the cylinder 20 and a rotation speed of the lower friction-reducing ring 60 relative to the position-limiting protrusion 43 are less than a rotation speed of the rotation shaft 30. As power consumption of the friction pairs is proportional to square of the rotation speed, the power consumption of the pump body assembly is reduced.

In this embodiment, the position-limiting protrusion 43 is a protruding ring extending toward the lower flange 12, and the protruding ring and the piston sleeve 40 are coaxially arranged. Specifically, in the process of limiting and stopping the protruding ring by the lower flange 12, the protruding ring makes a force exerted on the piston sleeve 40 more uniform and stable, making the piston sleeve 40 operate more stably, and improving the operation reliability of the pump body assembly.

It should be noted that the structure of the position-limiting protrusion 43 is not limited to such. In one embodiment, the position-limiting protrusion 43 includes a plurality of protruding platforms extending toward the lower flange 12, and the plurality of protruding platforms are arranged at intervals along a circumference of the piston sleeve 40. The above arrangement can not only make quality of the piston sleeve 40 reduced, but also make the structure of the piston sleeve 40 simpler, reducing processing costs of the piston sleeve 40.

Figure 22:
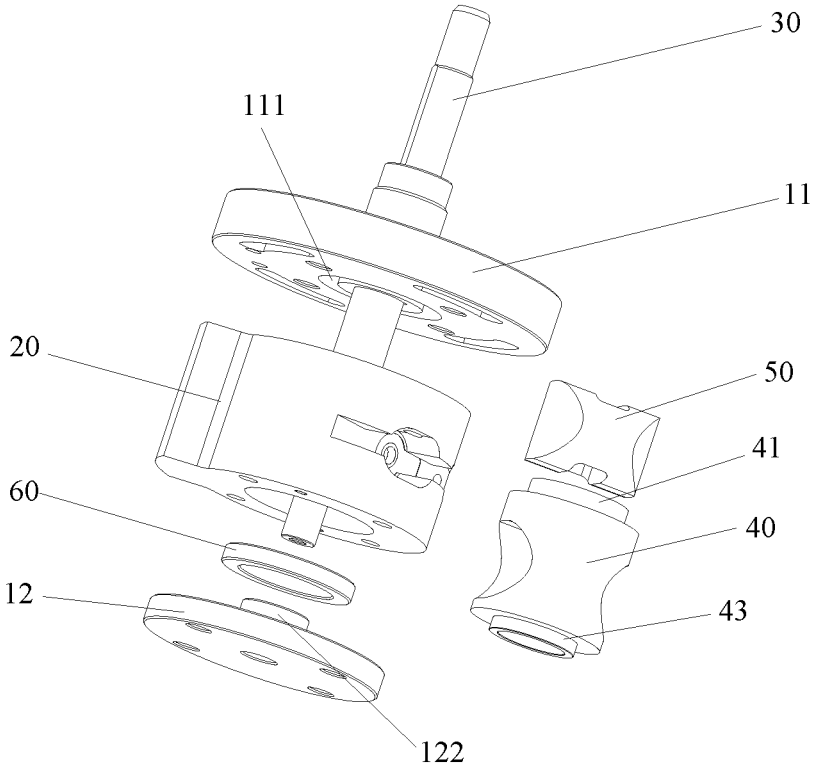
FIG. 22 shows a schematic exploded view of a pump body assembly according to a fifth embodiment of the present disclosure.
Figure 23:
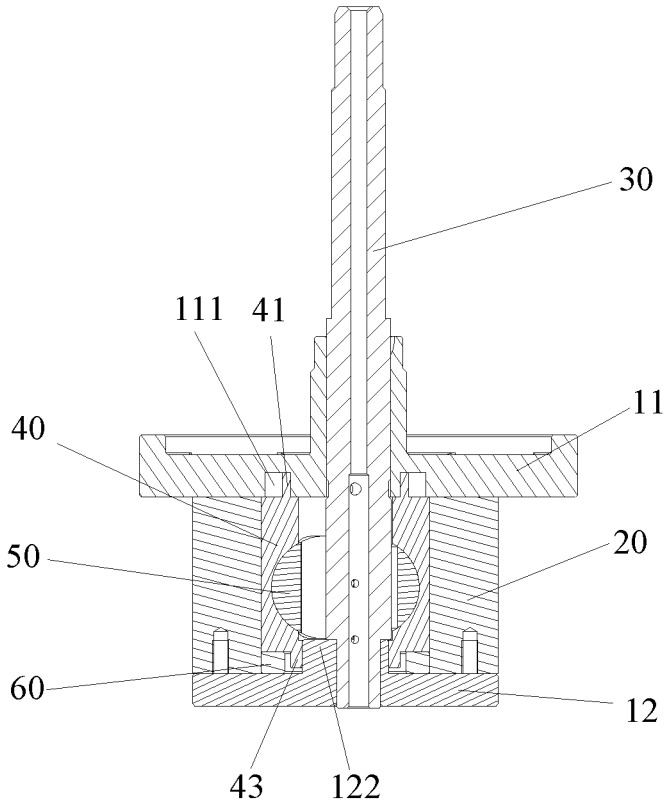
FIG. 23 shows a cross-sectional view of the pump body assembly in FIG. 22.
Figure 24:
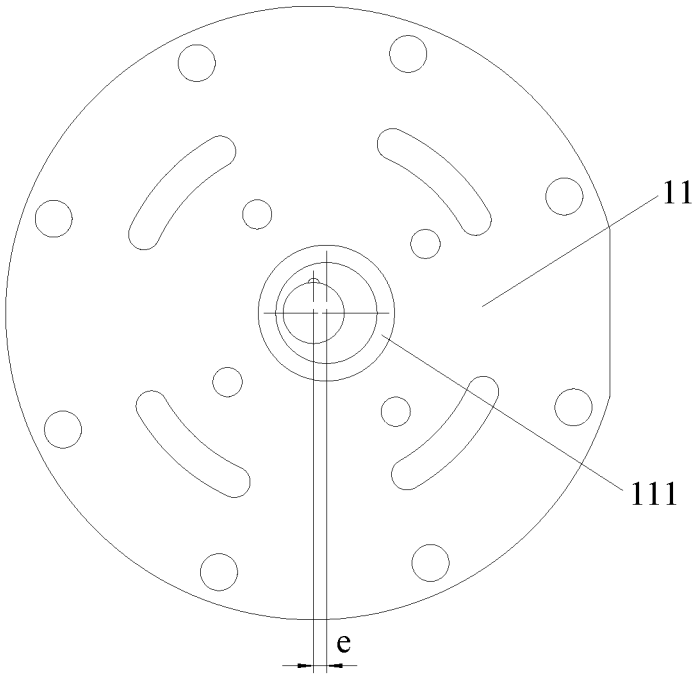
FIG. 24 shows a bottom view of an upper flange of the pump body assembly in FIG. 22.
Figure 25:
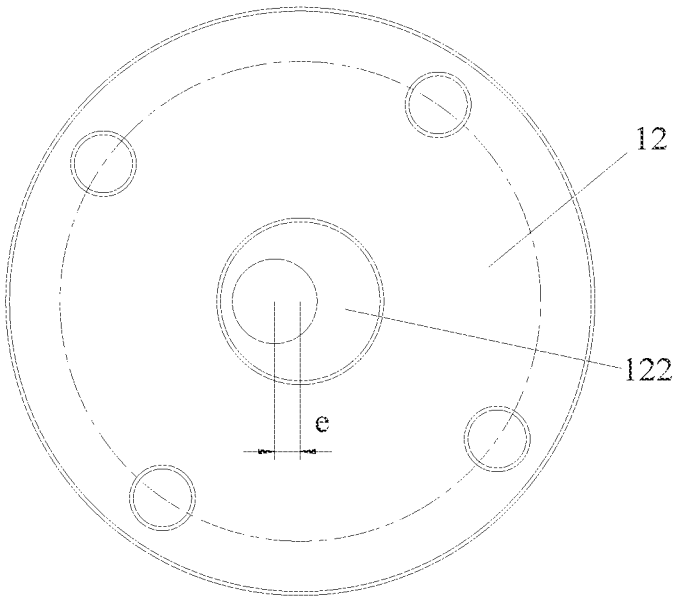
FIG. 25 shows a top view of a lower flange of the pump body assembly in FIG. 22.

As shown in FIG. 22, FIG. 23 and FIG. 25, a second extended part 122 is provided on the surface of the lower flange 12, and the surface of the lower flange 12 faces the piston sleeve 40. The second extended part 122 limits and stops the position-limiting protrusion 43, to prevent the piston sleeve 40 from moving in the radial direction relative to the lower flange 12. Specifically, a side surface of the second extended part 122 fits and limits a side surface of the position-limiting protrusion 43, preventing a relative radial displacement there between, further preventing the piston sleeve 40 from moving in the radial direction relative to the lower flange 12, ensuring the piston sleeve 40 to operate stably, and improving the operation reliability and the working efficiency of the pump body assembly.

As shown in FIG. 23, the second extended part 122 is located outside the position-limiting protrusion 43. Specifically, an inner side surface of the second extended part 122 limits and stops a side surface of the position-limiting protrusion 43, and the side surface of the position-limiting protrusion 43 is far away from the center of the piston sleeve, thus preventing a radial displacement there between.

In one embodiment, there is a second predetermined distance between the inner side surface of the second extended part 122 and the side surface of the position-limiting protrusion 43 away from the center of the piston sleeve 40, and the second predetermined distance is greater than or equal to 5 um, and less than or equal to 40 um. In this case, the above numerical range not only ensures that the second extended part 122 can limit the position-limiting protrusion 43 in the radial direction, but also enables the position-limiting protrusion 43 to rotate relative to the second extended part 122, improving the operation reliability of the pump body assembly.

In other embodiments not shown in the drawings, the second extended part is located inside the position-limiting protrusion. Specifically, an outer side surface of the second extended part limits and stops a side surface of the position-limiting protrusion, and the side surface of the position-limiting protrusion is adjacent to the center of the piston sleeve, preventing a radial displacement there between.

Sixth Embodiment

The pump body assembly of the sixth embodiment differs from that of the fifth embodiment in that the structure of the lower flange 12 is different.

In this embodiment, a second position-limiting groove is provided on the surface of the lower flange, and the surface of the lower flange faces the piston sleeve, and the position-limiting protrusion extends into the second position-limiting groove to prevent the piston sleeve from moving in the radial direction relative to the lower flange. In this case, the position-limiting protrusion not only fits and is limited by the central hole of the lower friction-reducing ring, but also fits the second position-limiting groove of the lower flange, further improving the operation stability of the piston sleeve.

In one embodiment, the second position-limiting groove is eccentrically arranged on the lower flange, and the eccentricity is e.

Seventh Embodiment

The pump body assembly of the seventh embodiment differs from that of the fourth embodiment in that the structure of the pump body assembly is different.

Figure 26:
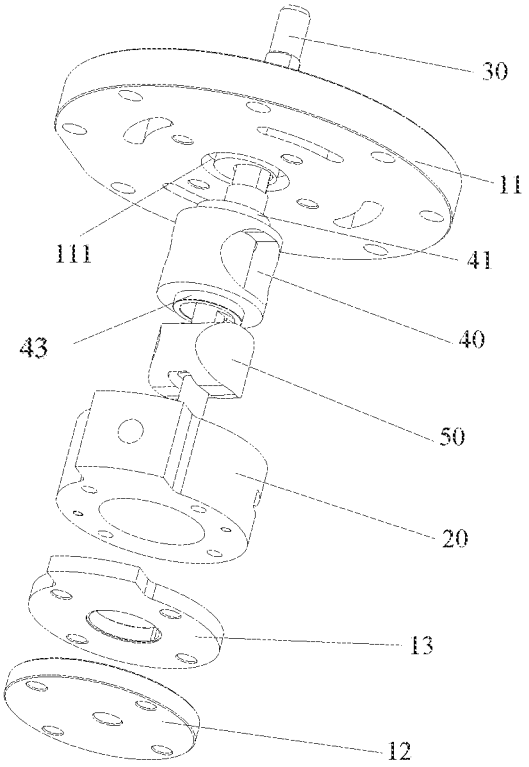
FIG. 26 shows a schematic exploded view of a pump body assembly according to a seventh embodiment of the present disclosure.
Figure 27:
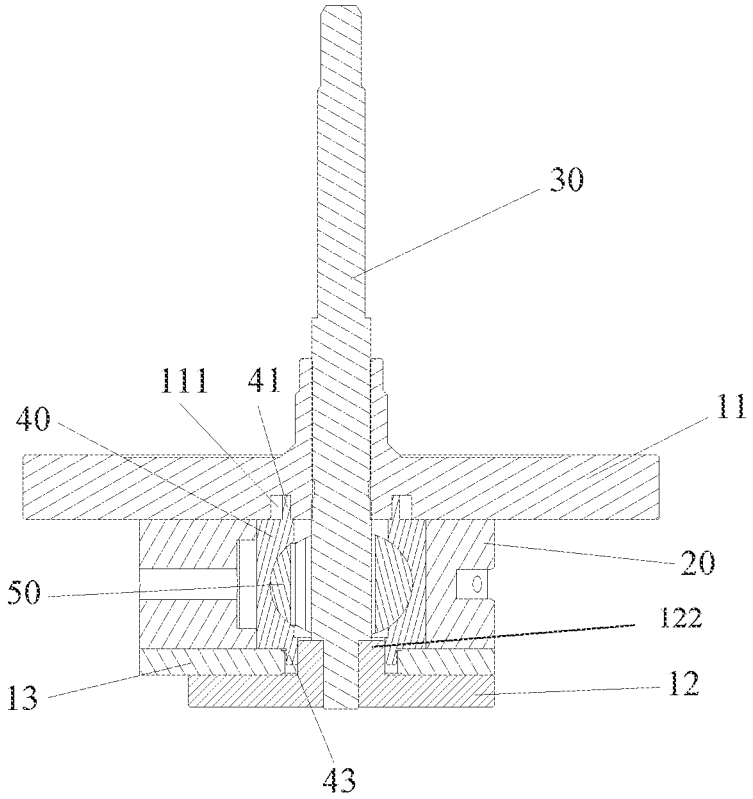
FIG. 27 shows a cross-sectional view of the pump body assembly in FIG. 26.
Figure 28:
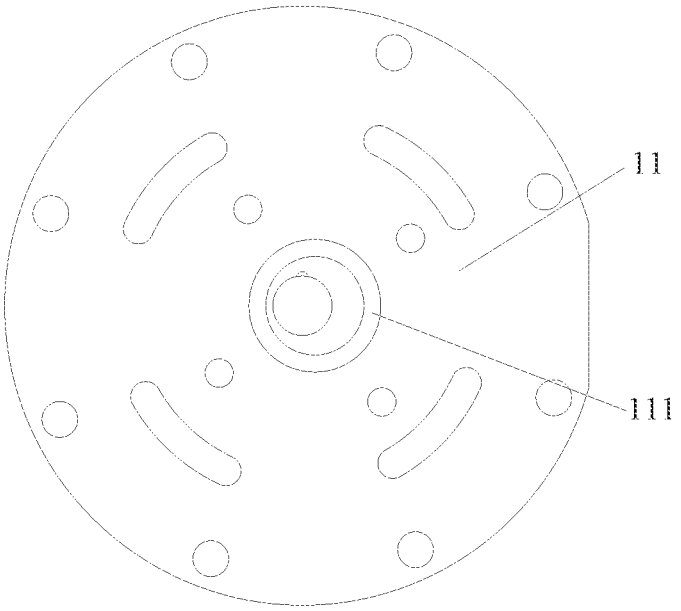
FIG. 28 shows a bottom view of the upper flange of the pump body assembly in FIG. 26.

As shown in FIGS. 26 to 28, the structure members further include the lower flange 12 and a lower position-limiting plate 13. The lower position-limiting plate 13 and the lower flange 12 are both disposed below the cylinder 20, and the lower position-limiting plate 13 is disposed between the cylinder 20 and the lower flange 12. The position-limiting protrusion 43 is limited and stopped by the lower position-limiting plate 13, to prevent the piston sleeve 40 from moving in the radial direction relative to the lower position-limiting plate 13. In this case, the position-limiting protrusion 43 of the piston sleeve 40 fits and is limited by the lower position-limiting plate 13 in the radial direction. At the same time, the upper end of the piston sleeve 40 is limited and supported by the upper flange 11, so that both the upper end and the lower end of the piston sleeve 40 are limited and supported, avoiding structural interference between the piston sleeve 40 and the piston 50 or the cylinder 20, which will affect the normal operation of the pump body assembly, and improving the operation reliability and the working performance of the pump body assembly.

As shown in FIG. 27, the position-limiting protrusion 43 extends into the central hole of the lower position-limiting plate 13, fits and is limited by the inner surface of the central hole of the lower position-limiting plate 13. Specifically, the lower position-limiting plate 13 is fixedly connected to the lower flange 12, and the outer surface of the position-limiting protrusion 43 is limited and stopped by the inner surface of the central hole, realizing, by the upper flange, the position limitation and the stop to the position-limiting protrusion 43 (piston sleeve 40), preventing the piston sleeve 40 from moving in the radial direction relative to the lower position-limiting plate 13 or the lower flange 12, and further improving the operation reliability of the pump body assembly.

Eighth Embodiment

The pump body assembly of the eighth embodiment differs from that of the seventh embodiment in that the structure of the lower position-limiting plate 13 is different.

In this embodiment, a surface of the lower position-limiting plate, which faces a surface of the piston sleeve, has a third position-limiting groove, and the position-limiting protrusion extends into the third position-limiting groove, and is limited and stopped by the third position-limiting groove. Specifically, the position-limiting protrusion fits a groove wall of the third position-limiting groove, to realize, by the lower position-limiting plate, the position limitation to the piston sleeve, making the piston sleeve operate more stably, and improving the operation reliability of the pump body assembly.

In one embodiment, the third position-limiting groove is a ring-shaped groove, and the ring-shaped groove and the central hole of the lower position-limiting plate are arranged coaxially.

From the above description, it can be seen that the above-mentioned embodiments of the present disclosure may achieve the following results:

during the operation of the pump body assembly, the upper end of the piston sleeve is limited and supported by the structure member disposed there above, preventing the piston sleeve from moving in the radial direction during operation, ensuring that the piston sleeve can rotate normally, and solving the problem known to the inventors that the working efficiency of the pump body assembly is affected because the piston sleeve of the pump body assembly is prone to rotate eccentrically, and improving the operation reliability and the working performance of the pump body assembly.

As such, the embodiment described above is only a part of the embodiment of the present disclosure, rather than the entire embodiment.

Apparently, the embodiments described above are merely part of the embodiments of the present disclosure, rather than all the embodiments. Based on the embodiments of the present disclosure.

It should be noted that terms used herein are only for the purpose of describing specific embodiments and not intended to limit the exemplary embodiments of the disclosure. The singular of a term used herein is intended to include the plural of the term unless the context otherwise specifies. In addition, it should also be appreciated that when terms "include" and/or "comprise" are used in the description, they indicate the presence of features, steps, operations, devices, components and/or their combination.

It should be noted that the terms "first", "second", and the like in the description, claims and drawings of the present disclosure are used to distinguish similar objects, and are not necessarily used to describe a specific order or time order. It should be appreciated that such terms can be interchangeable if appropriate, so that the embodiments of the disclosure described herein can be implemented, for example, in an order other than those illustrated or described herein.

What is claimed is:

1. A pump body assembly, comprising:

at least two structure members, a cylinder arranged between the two structure members, and a piston assembly arranged in the cylinder;

wherein the piston assembly comprises a piston sleeve and a piston slidably arranged in the piston sleeve; an upper end surface of the piston sleeve fits and is limited by a lower end surface of one structure member disposed above the piston sleeve to prevent the piston sleeve from moving in a radial direction relative to the one structure member;

a position-limiting protrusion is provided on a lower end surface of the piston sleeve;

the at least two structure members include the one structure member disposed above the cylinder and another structure member disposed below the cylinder, wherein the other structure member disposed below the cylinder comprises a lower flange and a lower position-limiting plate; the lower position-limiting plate is disposed between the cylinder and the lower flange; the position-limiting protrusion is limited and stopped by the lower position-limiting plate;

a second extended part is provided on the surface of the lower flange, and the surface of the lower flange faces the piston sleeve; the second extended part is located inside the position-limiting protrusion; and the second extended part limits and stops the position-limiting protrusion.

2. The pump body assembly according to claim 1, wherein one of the at least two structure members is disposed above the piston sleeve is an upper flange.

3. The pump body assembly according to claim 2, wherein the upper end surface of the piston sleeve has a first extended part; the lower end surface of the upper flange has a concave part; and the first extended part extends into the concave part, and is limited and stopped by the concave part in a radial direction of the piston sleeve.

4. The pump body assembly according to claim 2, wherein the pump body assembly further comprises a rotation shaft; the rotation shaft passes through the upper flange, the piston sleeve, and the lower flange in sequence; and the rotation shaft, the upper flange, and the lower flange are arranged coaxially.

5. The pump body assembly according to claim 1, wherein the position-limiting protrusion extends into a central hole of the lower position-limiting plate, fits and is limited by an inner surface of the central hole of the lower position-limiting plate.

6. Fluid machinery, characterized by comprising the pump body assembly according to claim 1.

7. A heat exchange device, characterized by comprising the fluid machinery of claim 6.

* * * * *